US006591735B2

(12) United States Patent
Sud et al.

(10) Patent No.: US 6,591,735 B2
(45) Date of Patent: Jul. 15, 2003

(54) SWASHPLATE COMPRESSOR PISTON HAVING AN EXTRA SUPPORT SURFACE

(75) Inventors: Lavlesh Sud, Farmington Hills, MI (US); Mirza Qadir M. Baig, Inkster, MI (US); Srinivas S. Pitla, Farmington Hills, MI (US); Vipen Khetarpal, Nov, MI (US); Yong Huang, Ann Arbor, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 150 days.

(21) Appl. No.: 09/782,779

(22) Filed: Feb. 13, 2001

(65) Prior Publication Data

US 2002/0108490 A1 Aug. 15, 2002

(51) Int. Cl.[7] ..... F01B 3/10
(52) U.S. Cl. ..... 92/71; 92/165 R
(58) Field of Search ..... 92/165 R, 177, 92/71; 91/499, 12.2

(56) References Cited

U.S. PATENT DOCUMENTS 3,939,717 A 2/1976 Teisen
5,382,139 A 1/1995 Kawaguchi et al.
5,615,599 A * 4/1997 Terauchi ..... 92/165 R
5,816,134 A 10/1998 Takenaka et al.
5,921,756 A 7/1999 Matsuda et al.
5,988,041 A 11/1999 Hiramatsu et al.
6,010,313 A * 1/2000 Kimura et al. ..... 92/71
6,325,599 B1 * 12/2001 Herder et al. ..... 92/71
6,422,128 B1 * 7/2002 Ahn ..... 92/71

FOREIGN PATENT DOCUMENTS

EP 0 952 341 A2 10/1999

* cited by examiner

*Primary Examiner*—Edward K. Look
*Assistant Examiner*—Igor Kershteyn
(74) *Attorney, Agent, or Firm*—Brinks Hofer Gilson & Lione

(57) ABSTRACT

A swashplate type compressor that includes one or more pistons having an extra support surface for receiving a side load is provided. In a first preferred embodiment of the piston, a rotational restrictor that overlaps the head region is utilized as the extra support surface. In a second preferred embodiment, a support projection, separate from the head region, is utilized as the extra support surface. The extra support surface of the piston of the present invention receives a portion of the side load exerted on the piston, thereby relieving some of stress applied to the head region.

21 Claims, 7 Drawing Sheets

SWASHPLATE COMPRESSOR PISTON HAVING AN EXTRA SUPPORT SURFACE

FIELD OF THE INVENTION

The present invention relates to the field of pistons for use in swashplate type compressors.

BACKGROUND OF THE INVENTION

Swashplate compressors use a swashplate disposed on a shaft at an angle to translate rotational movement into linear movement of a piston. The piston movement allows for compression of a gas within the cylinder bore. In these compressors, a side load can be exerted on the piston, adding stress to the piston. The present invention provides an extra support surface for receiving a portion of the side load, thereby reducing the side load experienced by the main body of the piston.

BRIEF DESCRIPTION OF A PRIOR ART SWASHPLATE TYPE COMPRESSOR

Figure 1:
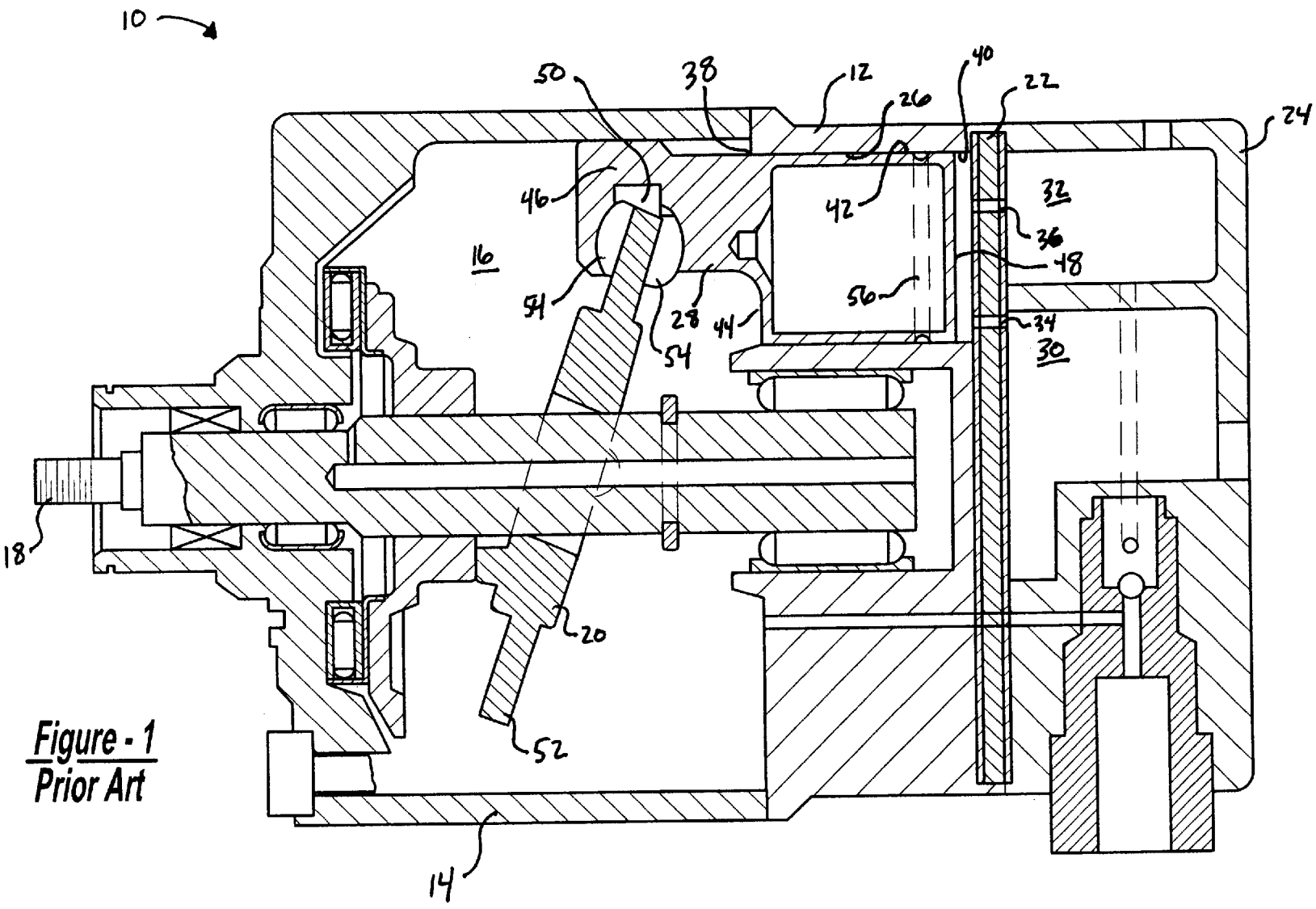
Figure - 1 Prior Art
FIG. 1 is a cross-sectional view of a prior art swashplate type compressor.

FIG. 1 illustrates a prior art swashplate type compressor, generally indicated in the drawings as reference 10. The compressor 10 is known in the art and will not be described in detail herein. Briefly, the compressor 10 includes a cylinder block 12, a housing 14 that defines a crank chamber 16, a drive shaft 18, a swashplate 20, a valve plate 22, a rear housing 24, at least one cylinder bore 26, and at least one piston 28. The rear housing defines a suction chamber 30 and a discharge chamber 32, and the valve plate 22 defines a suction port 34 and a discharge port 36. The drive shaft 18 is supported by the housing 14 such that a portion of the drive shaft 18 is disposed within the crank chamber 16. The swashplate 20 is fixedly attached to the drive shaft 18 and is wholly contained within the crank chamber 16. The swashplate 20 is mounted on the drive shaft 18 such that it is tilted away from a plane perpendicular to the longitudinal axis of the drive shaft 18.

The cylinder block 12 defines the cylinder bore 26. The piston 28 is disposed within the cylinder bore 26 such that the piston 28 can slide in and out of the bore 26. This slideable movement of the piston 28 is possible, at least in part, due to the presence of a narrow gap 38 between the interior surface 40 of the cylinder block 12 in the cylinder bore 26 and the exterior surface 42 of the piston 28.

Figure 2:
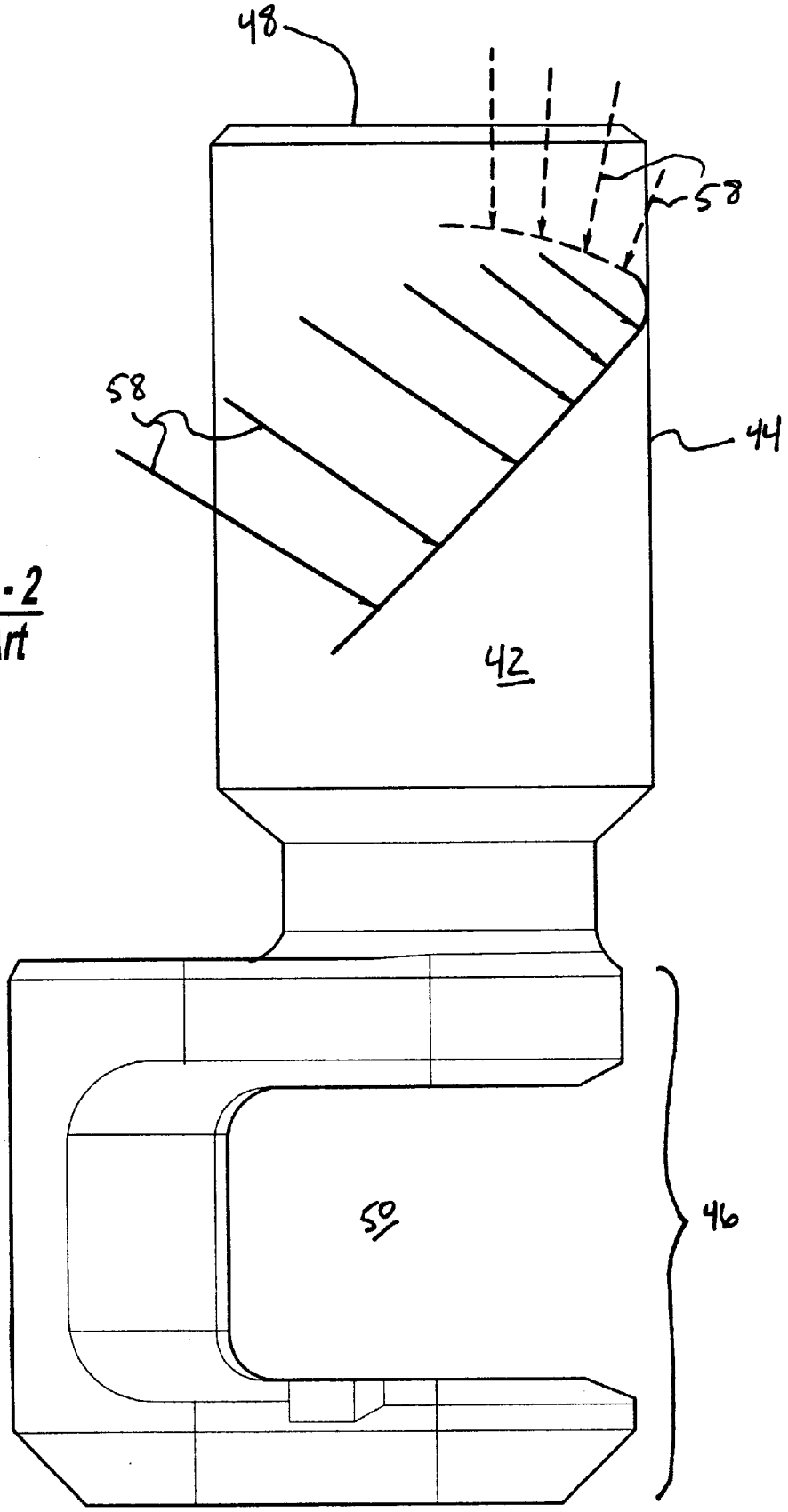
Figure - 2 Prior Art
FIG. 2 is a side view of a prior art piston.

As best illustrated in FIG. 2, the piston 26 of the prior art compressor 10 shown in FIG. 1 includes a head region 44 and a swashplate engaging region 46. The head region 44 is preferably a solid portion having a cross-section slightly smaller than that of the cylinder bore 26. The head region 44 provides the end surface 48 that compresses gas within the cylinder bore 26 as the piston 28 reciprocates. The swashplate engaging region 46 is located opposite the head region 44 and preferably defines a recess 50 capable of receiving at least the periphery 52 of the swashplate 20. Shoes 54 may be seated in the swashplate engaging region 46 and about the swashplate 20. The engagement of the swashplate 20 by the piston 28 at the swashplate engaging region 46 affects the translation of rotary movement of the shaft 18 and attached swashplate 20 to linear reciprocating movement of the piston 28 within the cylinder bore 26, thereby enabling compression within the cylinder bore 26.

Some swashplate compressors utilize blowby gas to lubricate parts in the crank chamber 16. Blowby gas is the refrigerant gas being compressed that leaks into the crank chamber 16 through the gap 38 between the cylinder block 12 and the piston 28. Lubricating oil is suspended in the blowby gas, thereby constituting a mist, and serves as the lubricant. The amount of blowby gas, and therefore the amount of lubricant, that ultimately reaches the crank chamber 16 is dependent, at least in part, on the size of the gap 38.

To facilitate movement of blowby gas, and consequently lubricating oil, to the crank chamber 16, the piston 28 can include one or more grooves 56. Preferably, the groove 56 comprises an annular groove 56 in or near the head region 44 of the piston 28. Lubricating oil adheres to the surface of the cylinder block 12 during operation of the compressor 10 and the annular groove 56 collects the oil as the piston 28, the annular groove 56 is exposed to the crank chamber 16 and releases the collected oil to the parts therein, including the swashplate 20 and shoes 54. Thus, grooves 56 in the exterior surface 42 of the piston 28 provide a mechanism to facilitate the movement of lubricating oil to the crank chamber 16 without needing to increase the size of the gap 38. As a result, it is desirable to increase the overall size of the grooves 56 on the surface of the piston 28.

Figure 3:
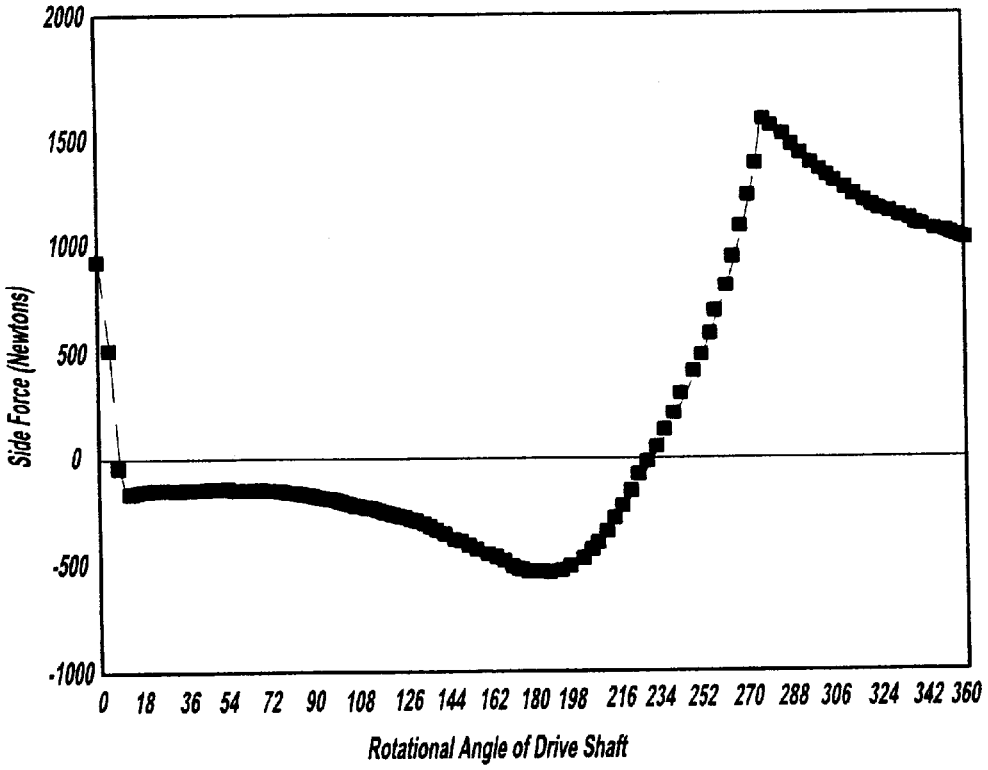
Figure - 3 Prior Art
FIG. 3 is a graph showing the relationship between the location of a prior art piston in its stroke and the level and location of the side load acting on the piston.
Figure 3:
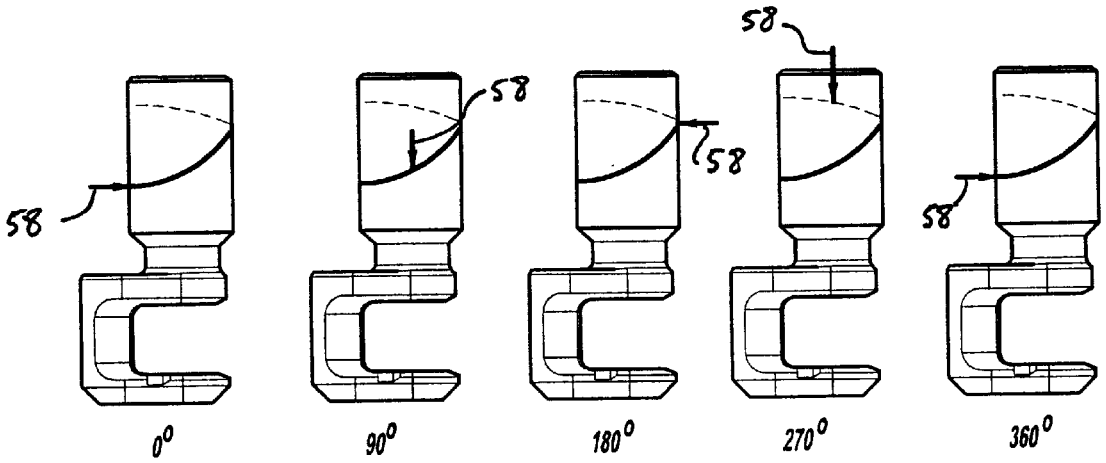
Figure - 3 Prior Art

When adding a groove 56 to the surface 42 of the piston 28, a side load 58 is experienced by the piston 28. The side load 58 is illustrated as a series of force lines in FIG. 2. The side load 58 refers to the reaction force from the interior surface 40 of the cylinder block 12 received by the piston 28. The reaction force is produced by a compression force and the inertial force of the piston 28. Due to the reciprocating action of the piston 28, the position at which the piston 28 receives the side load 58 varies as the piston 28 moves in and out of the cylinder bore 26. That is, as the piston 28 moves between its top dead center and bottom dead center positions, the side load is exerted on a varying region of the exterior surface 42 of the piston 28. The side load is described in greater detail in U.S. Pat. No. 5,816,134 to Takenaka et al., for "A COMPRESSOR PISTON AND PISTON TYPE COMPRESSOR" which is hereby incorporated by this reference in its entirety. FIG. 3 is a graph illustrating both the extent of the side load 58 and its location on the exterior surface 42 of the piston 28 throughout a compression stroke of the piston 28. As shown in FIG. 2, over the course of the compression stroke, a helical region on the exterior surface 42 of the piston 28 receives the side load 58.

DETAILED DESCRIPTION OF PREFERRED EMBODIMENTS OF THE INVENTION

An extra support surface according to the present invention provides the piston 28 with a greater surface area onto which the side load 58 can be received, thereby reducing some of the stress applied to the head region 44 of the piston 28. The extra support surface can take a variety of forms, and is best illustrated by the following two embodiments. It will be appreciated that the embodiments listed are merely illustrative of the present invention, and are not intended in any way to limit the scope of the present invention.

FIGS. 4–7 illustrate preferred embodiments of the present invention. In all figures, similar reference numbers refer to like parts.

Figure 4:
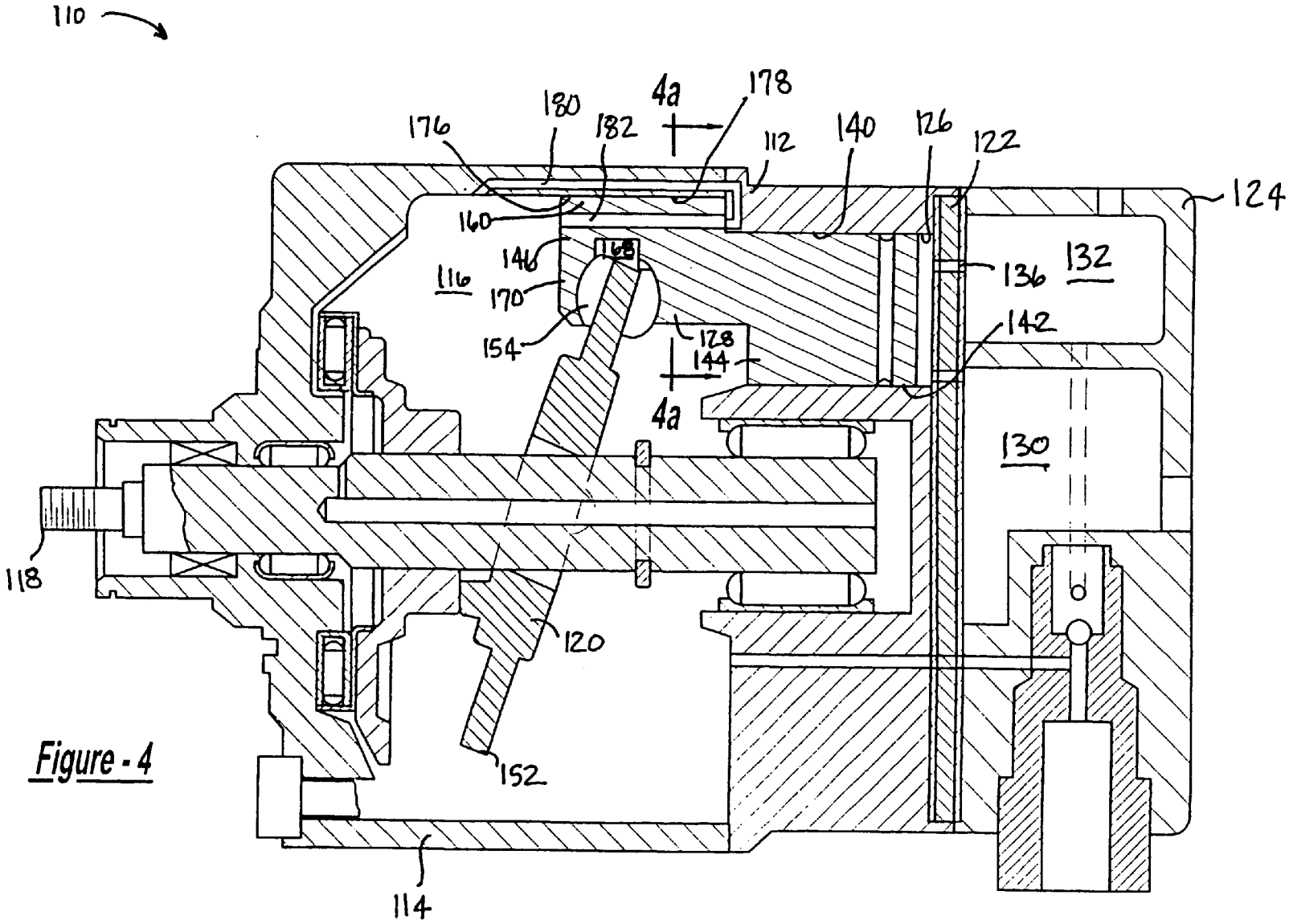
FIG. 4 is a cross-sectional view of a swashplate type compressor having a piston that utilizes a rotational restrictor as an extra support surface in accordance with the present invention.
Figure 4A:
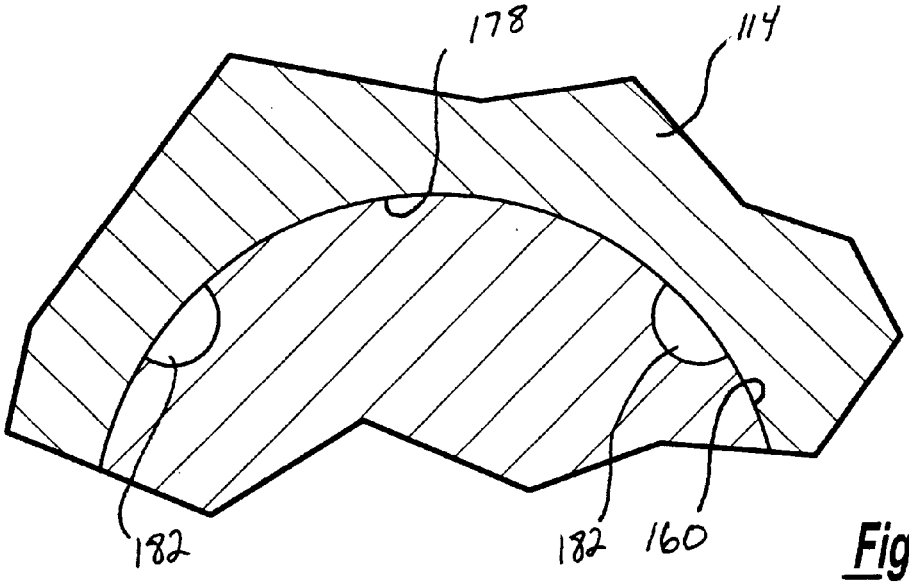
FIG. 4*a* is a cross-sectional view taken along line 4*a*—4*a* in FIG. 4.
Figure 6A:
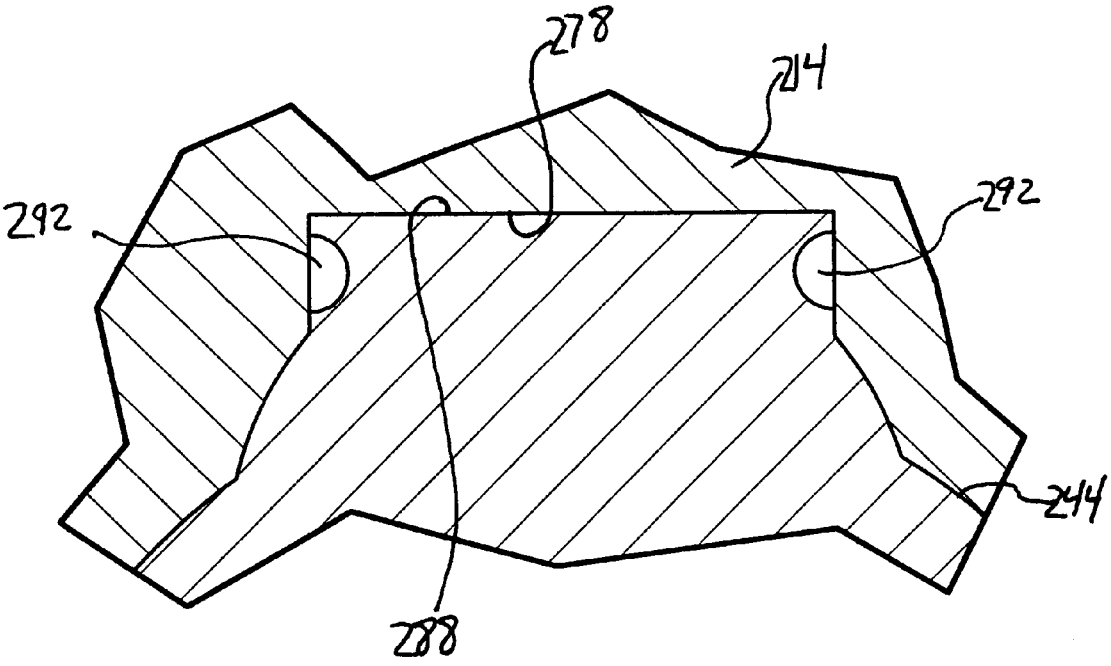
FIG. 6*a* is a cross-sectional view taken along line 6*a*—6*a* in FIG. 6.

FIG. 4 illustrates a swashplate type compressor 110 incorporating a first exemplary embodiment of the present invention. In this embodiment, the piston 128 includes a rotational restrictor 160, and a portion of the rotational restrictor 160 is utilized as the extra support surface for receiving the side load 158. It is known in the art to use rotational restrictors to prevent a piston from rotating within the cylinder bore. Rotational restrictors can take on a variety of forms. The novel form of the rotational restrictor 160 of the piston 128 according to the present invention, and its relation to the head region 144, confer an ability on the rotational restrictor 160 to receive a portion of the side load 158.

Figure 5:
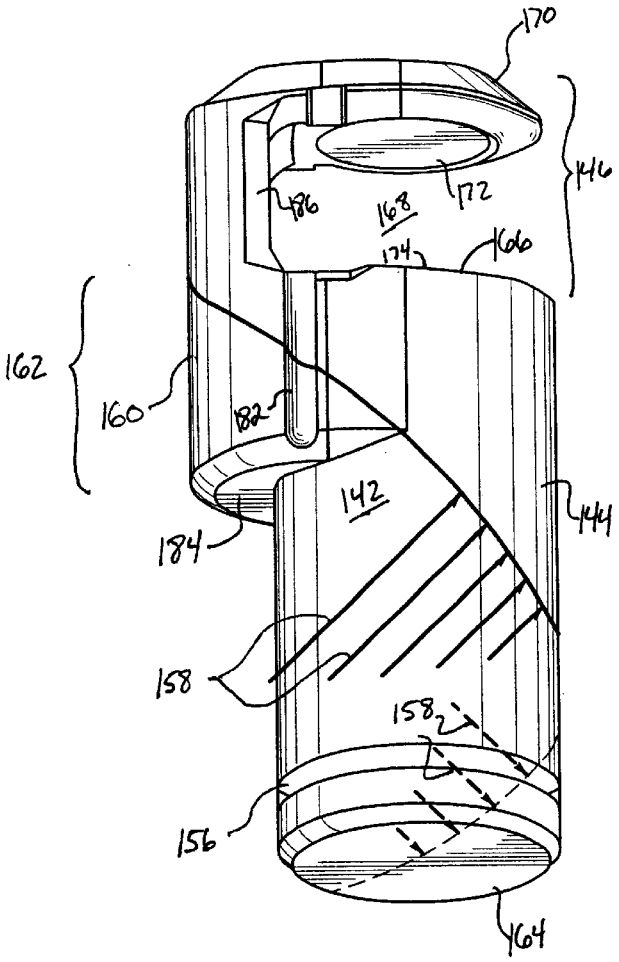
FIG. 5 is a perspective view of a piston that utilizes a rotational restrictor as an extra support surface in accordance with the present invention.

As shown in FIG. 5, the illustrative piston 128 includes a head region 144, a swashplate engaging region 146, a rotational restrictor 160, and an overlap region 162. The head region 144 has first 164 and second 166 ends, and can be slideably fitted into the cylinder bore 126 of the swashplate type compressor 110. The first end 164 defines the end surface 148 that serves to compress gas in the cylinder bore 126 as the piston 128 reciprocates between its top dead center position and bottom dead center position. The head region 144 preferably includes a groove 156 in its exterior surface 142 for collecting gas and suspended lubricating oil from the cylinder bore 126 and moving the oil to the crank chamber 116. The groove 156 may be annular in nature and may be positioned anywhere along the surface 142 of the head region 144. Alternatively, the groove 156 may be longitudinal or helical in nature.

The swashplate engaging region 146 of the piston 128 defines the structural features responsible for interacting with the swashplate 120 of the compressor 110, and therefore defines the portion of the piston 128 that translates the rotational movement of the drive shaft 118 and swashplate 120 to linear movement of the piston 128 within the cylinder bore 126. The swashplate engaging region 146 defines a recess 168 between the second end 166 of the head region 144 of the piston 128 and the opposing arm 170 of the piston 128. The swashplate engaging region 146 preferably includes first 172 and second 174 shoe seats. The shoe seats 172, 174 are structural features that allow the shoes 154 to be accommodated by the piston 128 during operation of the compressor 110. Within the recess 168, a shoe 154 is preferably positioned in each of the shoe seats 172, 174, and swashplate 120 is received between the two shoes 154. During operation of the compressor 110, the shoes 154 and the swashplate 120 move between two positions within the recess 168 as the piston 128 moves between its top dead center and bottom dead center positions.

Preferably, the rotational restrictor 160 defines a projection that extends away from the longitudinal axis of the piston 128. While the exterior surface of the rotational restrictor 160 in the illustrated piston 128 defines a curvature similar to that of the head region 144, the rotational restrictor 160 can take on a variety of forms and it is not necessary that it reflect the shape or configuration of the head region 144. As illustrated in FIG. 4, the rotational restrictor 160 is capable of slideably fitting within the secondary bore 176 of the swashplate type compressor 110. Due to the interaction between the surface of the rotational restrictor 160 and the interior surface 178 of the secondary bore 176, the piston 128 is prevented from rotating within the main cylinder bore 126 of the cylinder block 112. The secondary bore 176 is preferably in communication within the main bore 126 of the cylinder block 112. Particularly preferred is a secondary bore 176 that, in conjunction with the main bore 126, defines a void in the block 112 that is complimentary to the shape of the piston 128 including the rotational restrictor 160.

The overlap region 162 comprises the region in common between the rotational restrictor 160 and the head region 144. The overlap region 162 extends from the second end 166 of the head region 144 and toward the first end 164 of the head region 144. The overlap region 162 represents a transition from the surface of the head region 144 to the surface of the rotational restrictor 160. As such, the overlap region 162 allows a portion of the side load 158 exerted on the head region 144 to be received by the rotational restrictor 160.

While the rotational restrictor 160 is slideably fitted into the secondary bore 176 of the cylinder block 112, it is preferred that the rotational restrictor 160 not provide any additional compression to the compressor 110. That is, it is preferred that the rotational restrictor 160 is not capable of compressing gas within the secondary bore 176 as the piston 128 move between its top dead center and bottom dead center positions. Some compression of gas may occur in the secondary bore 176 despite the structural features of the housing 114 and/or rotational restrictor 160. Thus, the preferred lack of compression encompasses any level of compression within the secondary bore 176 that is less than that which occurs in the main cylinder bore 126. A minimal level of compression within the secondary bore 176 is particularly preferred. This allows the rotational restrictor 160 to be free from substantial additional forces.

To accomplish this minimal level of compression, the secondary bore 176, as detailed above, can define escape passageway 180 that allows gas within the secondary bore 176 to escape as the rotational restrictor 160 moves within the secondary bore 176. Preferably, the escape passageway 180 provides a return passageway to the crank chamber 116. Because it may prove difficult to machine such an escape passageway 180 in the cylinder block 112, it is preferable to include structural features on the rotational restrictor 160 that ensure that the rotational restrictor 160 does not provide significant additional compression. As such, it is preferable that the rotational restrictor 160 include a groove 182 or other void in the surface that communicates with the first end 184 of the rotational restrictor 160 and the swashplate engaging region 146. That is, the groove 182 provides communication between the secondary bore 176 and the crank chamber 116. The groove 182 allows gas to escape from the secondary bore 176 to the recess 50 of the swashplate engaging region 146 as the rotational restrictor 160 moves into the secondary bore 176. Furthermore, this also provides another route for returning lubricating oil suspended in the gas to the moving parts of the compressor 110, specifically the swashplate 120 and shoes 154, in the crank chamber 116. Preferably, as illustrated in FIG. 5, the groove 182 is linear in nature, extending parallel to the longitudinal axis of the piston 128. Alternatively, the groove 184 can be helical in nature, winding around the rotational restrictor 160. Also alternatively, the groove 182 can take any form so long as it provides the communication between the secondary bore 176 and crank chamber 116 that facilitates a minimal level of compression within the secondary bore 176.

To further facilitate lubrication, the rotational restrictor 160 can also define one or more channels 186 positioned at the base of the recess 168 that have surfaces directed toward the center of the recess 168. In operation, these channels 186 provide an additional surface that directs gas and suspended lubricating oil towards the swashplate 120 and shoes 154 within the recess 168 of the swashplate engaging region 146.

In this piston 128, the side load 158 is dissipated by the rotational restrictor 160. As illustrated in FIG. 5, a portion of the side load 158 exerted on the piston 128 is received by the overlap region 162 of the piston 128. Because the overlap region 162 is part of the rotational restrictor 160 and extends outward from the head region 144, an additional surface is provided for receiving the side load 158. This receipt of a portion of the side load 158 by the overlap region 162 reduces the side load experienced by the head region 144.

Figure 6:
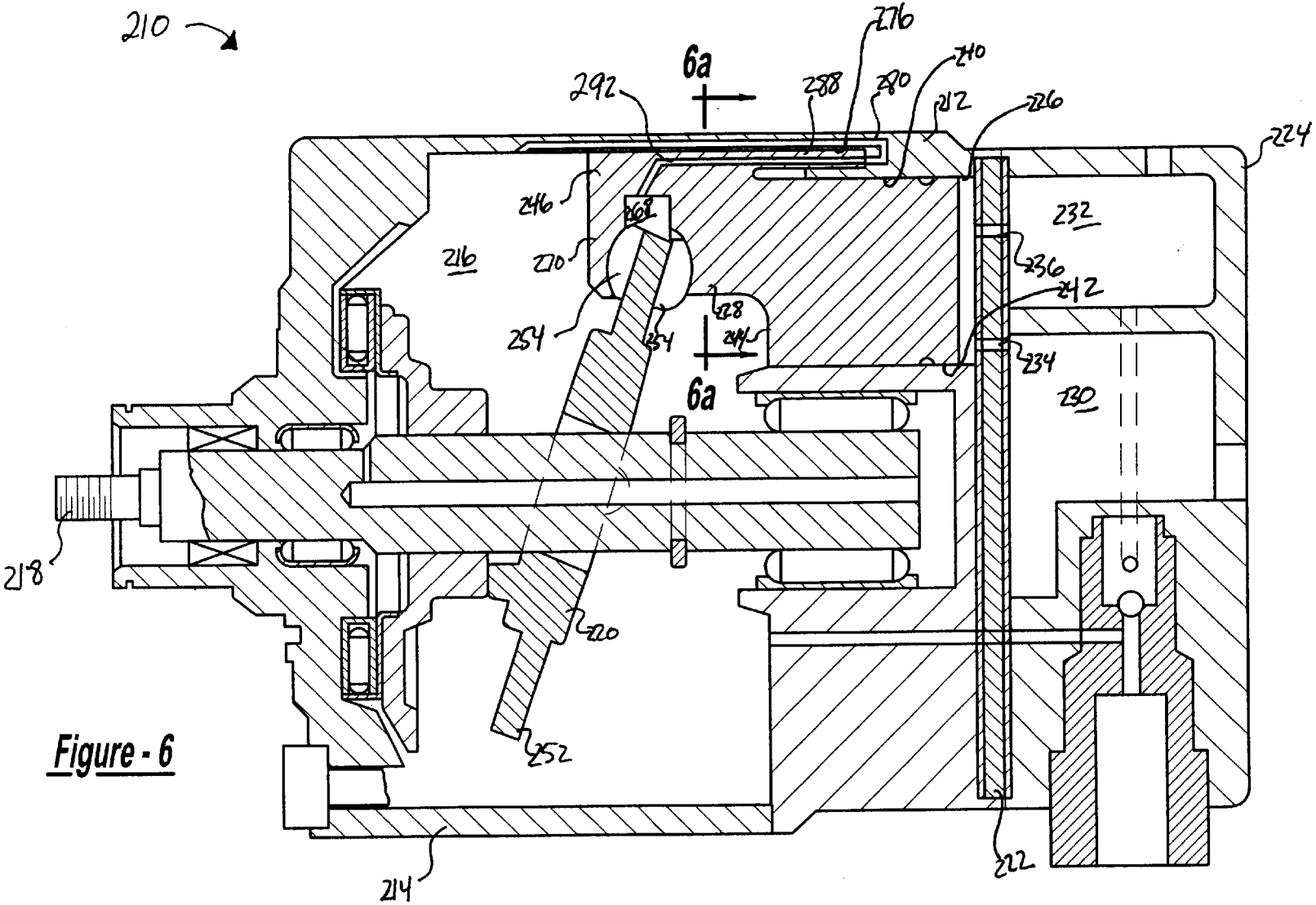
FIG. 6 is a cross-sectional view of a swashplate type compressor having a piston that utilizes a support projection as an extra support surface in accordance with the present invention.

FIG. 6 illustrates a swashplate type compressor 210 incorporating a second exemplary embodiment of the present invention. In this embodiment, a support projection 288 is included as an integral part of the piston 228 and is utilized as the extra support surface for receiving a portion of the side load 258.

Figure 7:
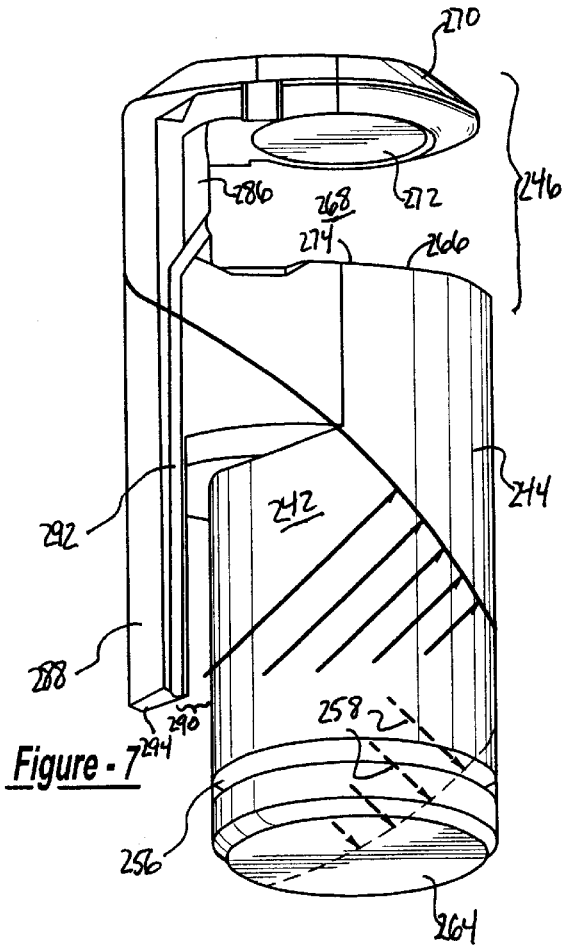
FIG. 7 is a perspective view of a piston that utilizes a support projection as an extra support surface in accordance with the present invention.

Similar to the piston 128 illustrated in FIGS. 4 and 5, the piston 228 shown in FIGS. 6 and 7 includes a head region 244 and a swashplate engaging region 246. In contrast to the piston 128 of FIGS. 4 and 5, however, the piston 228 shown in FIGS. 6 and 7 also includes a support projection 288. The head region 244 defines first 264 and second 266 ends. The head region 244 is capable of slideably fitting within the main cylinder bore 226 of the block 212. The first end 264 of the head region 244 defines an end surface 248 that compresses gas in the cylinder bore 226 as the piston 228 moves between its top dead center position and bottom dead center position. The head region 244 may include a groove 256 for collecting gas and suspended lubricating oil and returning the oil to the crank chamber 216.

Again, similar to the piston 128 in FIGS. 4 and 5, the swashplate engaging region 246 preferably comprises a recess 268 between the second end 266 of the head region 244 of the piston 228 and the opposing arm 270. The swashplate engaging region 246 preferably includes shoe seats 272, 274 for receiving the shoes 254 disposed about the swashplate 220 in the compressor 210.

The support projection 288 is preferably an elongated projection that sits adjacent the head region 244 of the piston 228. Also preferably, a gap 290 exists between the head region 244 and the support projection 288. The support projection 288 is capable of slideably fitting into the secondary bore 276 of the cylinder block 212.

In this embodiment, the secondary bore 276 is preferably not in communication with the main cylinder bore 226 of the compressor 210. Thus, both the main cylinder bore 226 and the secondary bore 276 are in communication with the crank chamber 216, but neither bore 226, 276 are in direct communication with each other. Nevertheless, similar to the embodiment illustrated in FIGS. 4 and 5, the secondary bore 276, in conjunction with the main bore 226, defines a void in the cylinder block 212 that is complimentary to the shape of the piston 228, including the support projection 288.

Preferably, the support projection 288 does not contribute significant additional compression to the compressor 210. This minimal level of compression is similar in scope to the minimal level of compression for the first embodiment, as detailed above. To achieve this minimal level of compression within the secondary bore 276, it is preferable to include structural features on the support projection 288 that allow gas to escape from the secondary bore 276 as the support projection 288 reciprocates within the bore 276. As such, it is preferable that the support projection 288 include a groove 292 that provides communication between the first end 294 of the support projection 288 and the recess 250 of the swashplate engaging region 246. It is preferred that the portion of this groove 292 that is on the support projection 288 extend along a line parallel to the longitudinal axis of the piston 228. Alternatively, the groove 292 can take any form so long as it is capable of providing communication between the secondary bore 276 and crank chamber 216 that facilitates a minimal level of compression within the secondary bore 276 when the piston 228 is installed in a compressor 210. Also alternatively, the groove 292 can communicate with the first end 294 of the support projection 288 and the gap 290 between the head region 244 and the support projection 288. The groove 292 allows gas to escape from the secondary bore 276 as the support projection 288 moves into the secondary bore 276, thereby providing the desired minimal level of compression. This also provides another route for returning lubricating oil to the swashplate 220 and shoes 254.

As shown in FIG. 7, the support projection 288 of the piston 228 of this embodiment receives a portion of the side load 258.

Pistons incorporating the present invention are preferably comprised of aluminum. Alternatively, the pistons can be fabricated from steel or any other metal, alloy, or other material suitable for use in accordance with the present invention. Also pistons incorporating the present invention are preferably fabricated by techniques known in the art, such as machining and forging. Alternatively, the pistons can be made by any suitable process.

The foregoing disclosure is the best mode devised by the inventors for practicing the invention. It is apparent, however, that several variations in pistons having extra support surfaces in accordance with the present invention may be conceivable by one skilled in the art. Inasmuch as the foregoing disclosure is intended to enable one skilled in the pertinent art to practice the instant invention, it should not be construed to be limited thereby, but should be construed to include such aforementioned variations. As such, the present invention should be limited only by the spirit and scope of the following claims.

We claim:

1. A swashplate type compressor that compresses a gas, said compressor comprising:

a cylinder block, a main bore, a secondary bore, a housing and a crank chamber defined by the cylinder block and the housing;

a driveshaft having first and second ends and rotatably mounted in the cylinder block such that the first end is disposed within the crank chamber;

a swashplate mounted on the first end of the driveshaft;

a piston having a head region, a swashplate engaging region, and an extra support surface;

the main bore capable of slideably receiving the head region and the secondary bore capable of slideably receiving the extra support surface such that the main and secondary bores allow the linear reciprocation of the piston;

a groove located between the secondary bore and the extra support surface, the groove allowing communication between the secondary bore and the crank chamber and substantially avoiding compression of gas within the secondary bore.

2. A swashplate type compressor according to claim 1, wherein the main bore and the secondary bore are in communication with each other and define a void in the cylinder block complimentary to the head region and the extra support surface of the piston.

3. A swashplate type compressor according to claim 1, wherein said main bore and the secondary bore comprise separate voids in the cylinder block such that each bore is in communication with the crank chamber defined by the cylinder block but no direct communication exits between the main and secondary bores.

4. A swashplate type compressor according to claim 1, wherein the secondary bore defines an escape passageway that allows removal of the gas from the secondary bore as the extra support surface moves into the secondary bore and substantially avoids compression of the gas within the secondary bore.

5. A swashplate type compressor according to claim 1, wherein the groove extends along a line parallel to the longitudinal axis of the piston.

6. A piston for use in a swashplate type compressor having a cylinder block, a main cylinder bore for compressing gas containing lubricating oil, a secondary cylinder bore, a housing, a crank chamber defined by the cylinder block and the housing, a driveshaft partially disposed in said crank chamber, and a swashplate mounted on said driveshaft; said piston having a longitudinal axis and comprising:

a head region having first and second ends, the first end defining a surface to compress a gas;

a swashplate engaging region defining a recess; and a rotational restrictor extending substantially parallel to said longitudinal axis and at a distance from the swashplate engaging region, the rotational restrictor being capable of preventing said piston from rotating about said longitudinal axis within said cylinder bore;

an overlap region existing between the rotational restrictor and the head region, said main cylinder bore slideably receiving the head region of said piston, said secondary cylinder bore slideably receiving the rotational restrictor and the rotational restrictor receiving a portion of a side load exerted on said piston during operation of said compressor;

the head region and the rotational restrictor defining a stepped profile.

7. A piston according to claim 6, wherein the head region further comprises a first groove for collecting said gas containing lubricating oil from said cylinder bore and returning said gas containing lubricating oil to said crank chamber.

8. A piston according to claim 7, wherein the first groove is annular.

9. A piston according to claim 6, wherein a second groove is located between the rotational restrictor and the secondary bore, the second groove allowing communication between said secondary bore and said crank chamber and substantially avoiding compression of said gas within said secondary bore.

10. A piston according to claim 9, wherein the second groove extends along a line parallel to said longitudinal axis of said piston.

11. A piston according to claim 9, wherein the rotational restrictor defines at least one channel located proximal to the second groove.

12. A piston for use in a swashplate type compressor having a crank chamber, a main cylinder bore for compressing gas containing lubricating oil, and a secondary cylinder bore, said piston having a longitudinal axis and comprising:

a head region having first and second ends, the first end defining a surface to compress a gas;

a swashplate engaging region defining a recess; and a support projection extending along a line parallel to said longitudinal axis of said piston, said main cylinder bore slideably receiving the head region, said secondary cylinder bore slideably receiving the support projection and the support projection receiving a portion of a side load exerted on said piston during operation of said compressor;

the support projection extending approximately from a plane parallel to the second end of the head region, along a line parallel to the longitudinal axis, and toward the first end of the head region.

13. A piston according to claim 12, wherein the head region further comprises a first groove for collecting said gas containing lubricating oil from said cylinder bore and returning said gas containing lubricating oil to said crank chamber.

14. A piston according to claim 13, wherein the first groove is annular.

15. A piston according to claim 12, wherein the head region and the support projection define a gap.

16. A piston according to claim 12, wherein a second groove is located between the support projection and the secondary bore, the second groove allowing communication between said secondary bore and said crank chamber and substantially avoiding compression of said gas within said secondary bore.

17. A piston according to claim 16, wherein the second groove extends along a line parallel to said longitudinal axis of said piston.

18. A piston for use in a swashplate type compressor having a cylinder block, a main cylinder bore for compressing gas containing lubricating oil, a secondary cylinder bore, a housing, a crank chamber defined by the cylinder block and the housing, a driveshaft partially disposed in said crank chamber, and a swashplate mounted on said driveshaft, said piston comprising:

a head region having first and second ends, the first end defining a surface to compress a gas;

a swashplate engaging region defining a recess;

support means for receiving a portion of a side load exerted on said piston; and communicative means that allow communication between said secondary bore and said crank chamber and substantially avoid compression of gas within said secondary bore.

19. A piston according to claim 18, wherein the communicative means is defined by the support means and the secondary bore.

20. A piston according to claim 18, wherein the communicative means includes a groove formed between the support means and the secondary bore.

21. A piston according to claim 20, wherein the communicative means includes a passageway defined by at least one of the housing and cylinder block.

* * * * *